United States Patent [19]

Stanford

[11] 4,081,657

[45] Mar. 28, 1978

[54] ELECTRICALLY HEATED ROOF DRIP EDGE STRIP

[76] Inventor: George H. Stanford, 191 Spurwink Rd., Scarborough, Me. 04074

[21] Appl. No.: 730,150

[22] Filed: Oct. 6, 1976

[51] Int. Cl.[2] ..... H05B 1/00

[52] U.S. Cl. ..... 219/213; 338/252; 338/311; 338/285

[58] Field of Search ..... 219/213, 200, 201, 535, 219/552, 549, 553; 52/11-16; 338/252, 311, 285

[56] References Cited

U.S. PATENT DOCUMENTS

| | | | |
|---|---|---|---|
| 2,699,484 | 1/1955 | Michaels | 219/213 |
| 2,757,273 | 7/1956 | Taylor | 219/549 |
| 3,521,029 | 7/1970 | Toyooka et al. | 219/213 X |
| 3,691,343 | 9/1972 | Norman | 219/213 |
| 3,725,638 | 4/1973 | Solin et al. | 219/213 |
| 3,821,512 | 6/1974 | Stanford | 219/213 |

*Primary Examiner*—C. L. Albritton

[57] ABSTRACT

A drip edge strip for a shingled roof is tapered and includes a first portion to be secured to the roof and provided with channels extending from end-to-end thereof and a second portion to underlie the first course of shingles and to cover the channels. A heating cable extends lengthwise of the channels.

5 Claims, 3 Drawing Figures

ELECTRICALLY HEATED ROOF DRIP EDGE STRIP

RELATED APPLICATION

Ser. No. 634,043, Filed Nov. 11, 1975

BACKGROUND REFERENCES

United States Letters Pat. No. 3,426,488
United States Letters Pat. No. 3,821,512
United States Letters Pat. No. 2,699,484
United States Letters Pat. No. 2,111,251

BACKGROUND OF THE INVENTION

It is commonly recognized that snow presents a particularly troublesome problem where buildings have shingled roofs.

While snow usually accumulates on a roof, it is the ice formed as the water from that snow, as it melts, and freezes in the gutters and thus prevent the drainage from the roof of water on further melting of the snow that is the source of the trouble. Once the drainage from any portion of a roof is thus blocked, water will eventually back up under the shingles and leak into the building.

This problem has long been recognized and the problem of ice forming in gutters is adequately met by gutters and downspouts in accordance with U.S. Pat. No. 3,821,512 and said application, Ser. No. 634,043.

A roof construction typically includes strips extending from the side of the building part way over a gutter and such are commonly referred to as drip edge strips. It has been proposed to provide for such a hollow metal strip with a heating element therein to prevent ice forming on the roof adjacent the gutter.

As far as I am aware, no electrically heated drip edge strip has been proposed that meets the requirements of production and installation and that ensures adequate control of icing problems. Instead, heating cables, disposed along the lower part of the roofs have been used but these usually are not found to be satisfactory.

THE PRESENT INVENTION

The general objective of the present invention is to provide tapered drip edge strips that are adapted to meet manufacturing and installation requirements and to enable a heating cable to be incorporated therein in a manner ensuring that icing is prevented.

In accordance with the invention, this objective is attained with a drip edge strip that has first and second portions, each a plastic extrusion with at least one portion tapered, the first portion to be secured to the roof and the second portion at least partially to underlie the first course of shingles. One portion has a series of channels for heating cable courses and the other portion covers the channels.

Another objective of the invention is to provide such drip edge strips that are best adapted to meet installation requirements and ensure efficient and safe operation, an objective attained with the first portion substantially thicker than the second portion and provided with the cable receiving channels which are each dimensioned to wholly contain a cable course. The second portion is sufficiently thin so that it represents an insignificant thermal barrier and is bonded, after the cable is installed, to the first portion at least on the lower side of the series of channels which are spaced apart to provide such support for the second portion as to prevent its contact with the cable courses.

BRIEF DESCRIPTION OF THE DRAWINGS

A preferred embodiment of the invention is illustrated by the accompanying drawings of which

THE PREFERRED EMBODIMENT OF THE INVENTION

Figure 1:
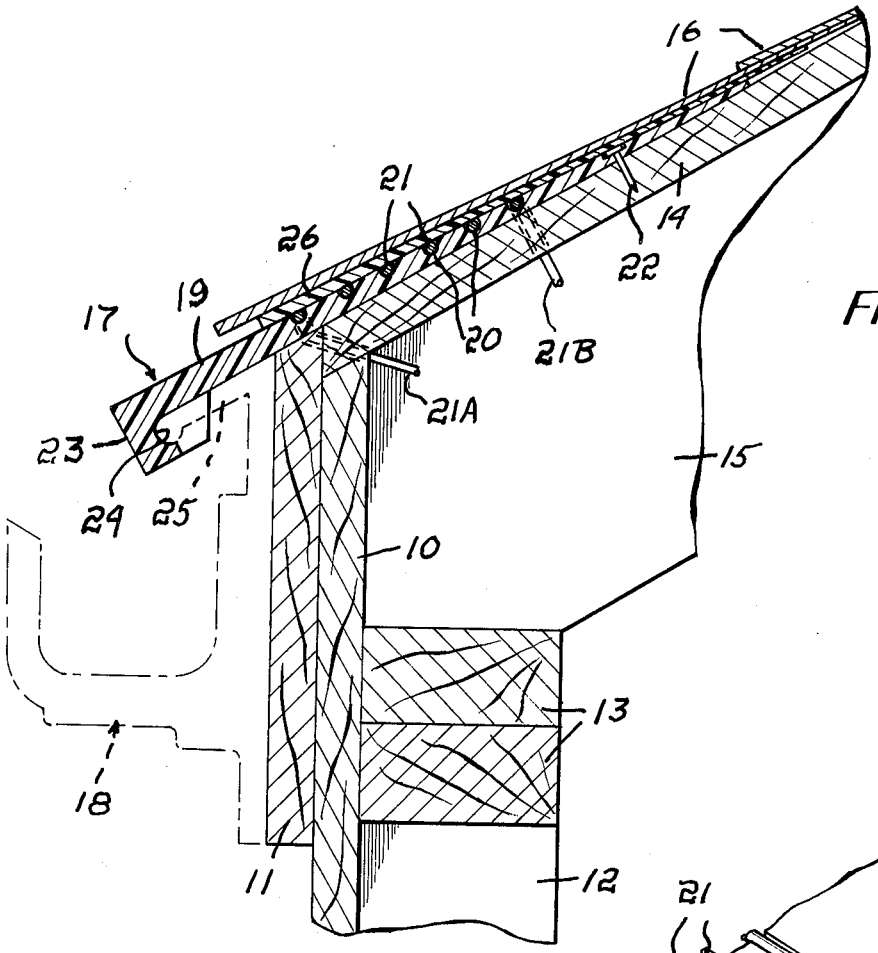
FIG. 1 is a section taken vertically through the eaves portion of a shingled roof.
Figure 2:
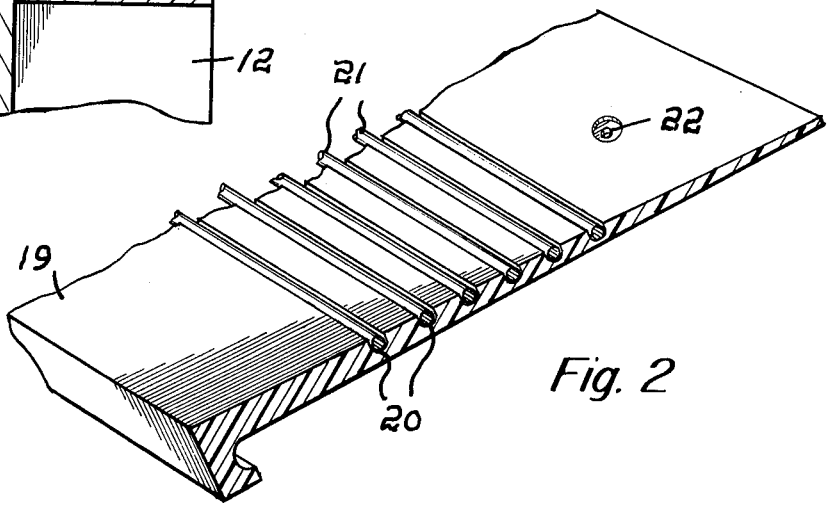
FIG. 2 is a perspective, sectional view of a part of the lower portion of the drip edge strip.
Figure 3:
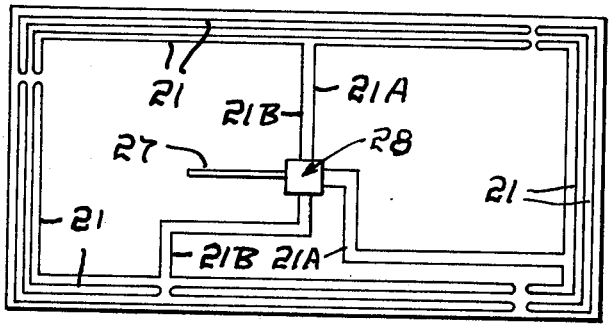
FIG. 3 is a schematic view of a circuit showing one arrangement of the heating cables.

A typical building construction, as illustrated by FIG. 1, has side wall sheathing 10 and a wood facia board 11 nailed to studding 12 and to a double side wall plate 13. The roof sheathing 14, supported by rafters 15, is covered by lengthwise courses of shingles 16 and a tapered drip edge strip, generally indicated at 17, the butt end of the strip 17 protruding from the side of the building and part way over the gutter, shown in phantom as of the type disclosed in said U.S. Pat. No. 3,821,512 and generally indicated at 18.

The drip edge strip 17 includes a first or lower portion in the form of a tapered plastic extrusion 19 having a series of parallel, lengthwise channels 20, each dimensioned to receive wholly within it a course of a heating cable 21 with its upper end secured to the sheathing as by nails 22 and with its butt end extending part way over the gutter 18 and shown as having a depending marginal rib 23 formed with a lengthwise channel 24 to receive the flange 25 of the gutter 18.

The drip edge strip 17 also includes a second or upper portion 26 in the form of a tapered plastic extrusion dimensioned to cover the channels 20 and the cable courses contained therein and to extend slightly beyond the upper end of the strip portion 19. The two extrusions are of plastics that are capable of being bonded together to ensure that moisture cannot work into the area of the grooves and while such materials are relatively poor thermal conductors and capable of withstanding the temperatures to which they are subjected when the cables are in use, the upper portion 26 of the strip 17 is sufficiently thin to ensure efficient heat transfer to the overlying shingle course 16. At the same time, the fact that the cable courses are wholly within the channels 20 and spaced apart to provide intermediate supports for the relatively thin and flexible upper portion 26 ensure that the cables will not be engaged by the upper portion even under the weight of snow or if the lower shingle course were stepped on by a workman.

The disposition of the heating cables 21 is dependent on many factors such as the size and shape of a building, the severity of and location of the icing problem or problems. Typically more than one cable would be required and each would be of a length such that it could be doubled upon itself a plurality of times, three times in the disclosed embodiment with the cable ends 21A and 21B extending into the attic to be connected to the main 110V AC circuit 27 by a junction 28 and subject to a manual or thermostatic control not shown. Where load conditions require the use of a relay providing an appropriate number of stages, such, of course, would be included.

In practice, each strip portion 19 is cut to the length wanted for a side of a building, for example, and mitered to provide a joint where it must meet another such length. Each portion 19 is then secured and the cable 21 installed in a selected manner. A strip portion 26, cut to the same length as the portion 19, is then placed in position to cover the channels, desirably with its upper margin extending slightly beyond the upper margin of the underlying portion 19 and two portions are then bonded together.

I claim:

1. A tapered drip edge strip for a shingled roof, said strip including a first layer to be secured to the roof and so dimensioned that a major transverse portion will underlie the first course of shingles, said major portion to be nailed to the roof through the upper part thereof, and a minor transverse portion will be exposed beyond the butt ends of the shingles thereof, said first layer a relatively thick plastic extrusion that is a poor thermal conductor, said first layer tapered with the lower edge the thicker edge, and a relatively thin second layer dimensioned to underlie said first course and to overlie said major portion of said first layer and sealable thereto, and one of said layers having a series of parallel channels located to closed by the other layer, each channel dimensioned to accommodate a heating cable course, said series spaced relative to the upper and lower edges of said major portion to enable the two layers to be sealed together, at least on the lower side of said series to secure the second layer to the attached first layer.

2. The drip edge strip of claim 1 in which the second layer extends beyond the upper, thinner edge of the first layer.

3. The drip edge strip of claim 2 in which the second layer is a tapered plastic extrusion.

4. The tapered drip edge strip of claim 1 in which the series of channels is in the major portion of the first layer and is located a substantial distance from the upper edge thereof to provide a substantial transverse area through which the attaching nails are to be driven.

5. The drip edge strip of claim 4 and a plurality of cable courses each lodged in a selected one of said channels, and the channels are so dimensioned that the courses are wholly contained therein and are so spaced as to provide supporting areas of substantial width between them.

* * * * *